US007604288B1

(12) United States Patent
Verhulst

(10) Patent No.: US 7,604,288 B1
(45) Date of Patent: Oct. 20, 2009

(54) PACK FRAME CONVERTIBLE BETWEEN A PACK SUPPORT AND A CHAIR

(75) Inventor: Lance G. Verhulst, Hot Springs, SD (US)

(73) Assignee: Magnus, Inc., Great Bend, KS (US)

( * ) Notice: Subject to any disclaimer, the term of this patent is extended or adjusted under 35 U.S.C. 154(b) by 93 days.

(21) Appl. No.: 11/546,769

(22) Filed: Oct. 12, 2006

(51) Int. Cl.
*A47C 13/00* (2006.01)

(52) U.S. Cl. ..... 297/129; 297/17

(58) Field of Classification Search ..... 297/129, 297/183.5, 17, 124, 125
See application file for complete search history.

(56) References Cited

U.S. PATENT DOCUMENTS

| | | | | |
|---|---|---|---|---|
| 2,843,185 | A | 7/1958 | Clem et al | |
| 3,250,449 | A | 5/1966 | Woodman | |
| 4,300,707 | A | 11/1981 | Kjaer | |
| 4,662,675 | A * | 5/1987 | Volpi | 297/124 |
| 4,676,548 | A | 6/1987 | Bradbury | |
| 5,044,690 | A * | 9/1991 | Torrey | 297/16.1 |
| 5,303,975 | A * | 4/1994 | Asato | 297/129 |
| 5,318,342 | A | 6/1994 | Hale | |
| 5,381,941 | A * | 1/1995 | Brune | 224/155 |
| 5,409,291 | A | 4/1995 | Lamb et al. | |
| 5,499,760 | A | 3/1996 | Pielocik | |
| 5,538,318 | A | 7/1996 | MacLean | |
| 5,547,246 | A * | 8/1996 | Lambert | 297/129 |
| 5,927,798 | A | 7/1999 | Ahn | |
| 6,048,023 | A * | 4/2000 | Lampton | 297/129 |
| 6,056,172 | A | 5/2000 | Welsh | |
| 6,547,324 | B1 * | 4/2003 | Ammann, Jr. | 297/129 |
| 6,789,809 | B2 | 9/2004 | Lin | |
| 6,997,507 | B2 | 2/2006 | Rhee | |
| 2002/0088829 | A1 | 7/2002 | Hsu | |

* cited by examiner

*Primary Examiner*—David Dunn
*Assistant Examiner*—Patrick Lynch
(74) *Attorney, Agent, or Firm*—Kenneth H. Jack; Davis & Jack, L.L.C.

(57) ABSTRACT

A pack frame convertible between a pack support and a chair is disclosed, and includes a primary element having opposite first and second ends and a secondary element pivotably mounted on the primary element with respect to the primary element. The primary and secondary elements are movable between a pack configuration and a chair configuration, with the pack configuration being characterized by the primary and secondary elements being oriented substantially parallel to each other and the chair configuration being characterized by the primary and secondary elements being in a skewed orientation with respect to each other. The pack frame includes a securing band for securing the primary element to the body of a user when the primary and secondary elements are in the pack configuration, and a seat for extending between the primary element and the secondary element when the primary and secondary elements are in the chair configuration.

14 Claims, 7 Drawing Sheets

PACK FRAME CONVERTIBLE BETWEEN A PACK SUPPORT AND A CHAIR

BACKGROUND OF THE INVENTION

1. Field of the Invention

The present invention relates to pack frames and more particularly pertains to a new pack frame convertible between a pack support and a chair that permits the pack frame to be used as a frame that supports a pack on the back of a user, and that can be easily unfolded and converted to a chair that the user may sit upon.

2. Description of the Prior Art

Pack frames with multiple configurations are known, and some have even been proposed that are configurable in a pack-carrying configuration and also in a chair or bench configuration. However, it is believed that these proposed pack frame apparatus tend to be excessively bulky, which makes the apparatus difficult to transport on the back of the user, and also tend to be overly complex, which can also add weight but also typically increases the cost of the apparatus. It also appear that some of the proposed pack frame apparatus are not especially comfortable to rest upon.

It is therefore believed that there is a need in the art for a convertible pack frame that provides a highly compact size for convenient transport while remaining as simple in construction as possible to provide easy operation and lower cost.

SUMMARY OF THE INVENTION

In view of the foregoing disadvantages inherent in the known types of pack frames now present in the prior art, the present invention provides a new pack frame convertible between a pack support and a chair construction that permits the pack frame to be used as a frame that supports a pack on the back of a user, and that can be easily unfolded and converted to a chair that the user may sit upon.

To attain this, the present invention generally comprises a pack frame convertible between a pack support and a chair. The convertible pack frame comprises a primary element having opposite first and second ends and a secondary element pivotably mounted on the primary element with respect to the primary element. The primary and secondary elements are movable between a pack configuration and a chair configuration, with the pack configuration being characterized by the primary and secondary elements being oriented substantially parallel to each other and the chair configuration being characterized by the primary and secondary elements being in a skewed orientation with respect to each other. A securing band may be included for securing the primary element to the body of a user when the primary and secondary elements are in the pack configuration. A seat may be included for extending between the primary element and the secondary element when the primary and secondary elements are in the chair configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the compact nature of the apparatus which provides the user with both a pack frame that supports provisions on the back of the user, yet also is capable of being converted into a chair in only a few actions. Further, the primary and secondary elements of the invention are able to be folded into a substantially flat and compact condition when in the pack configuration, and these same elements form the legs of the chair in the chair configuration without additional elements or structures to increase the weight and/or complexity of the device.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
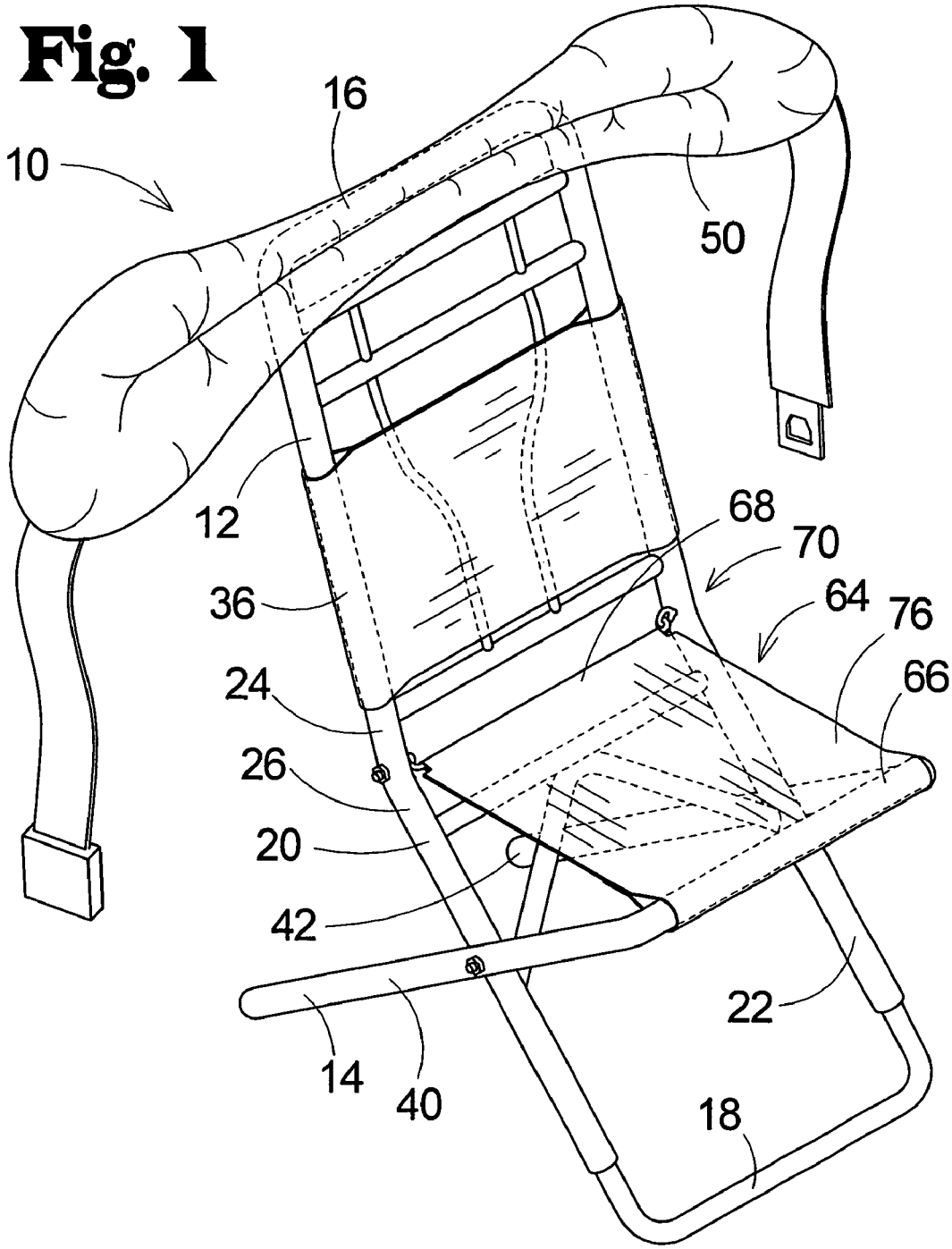
FIG. 1 is a schematic perspective view of a new convertible pack frame according to the present invention in a chair configuration.
Figure 2:
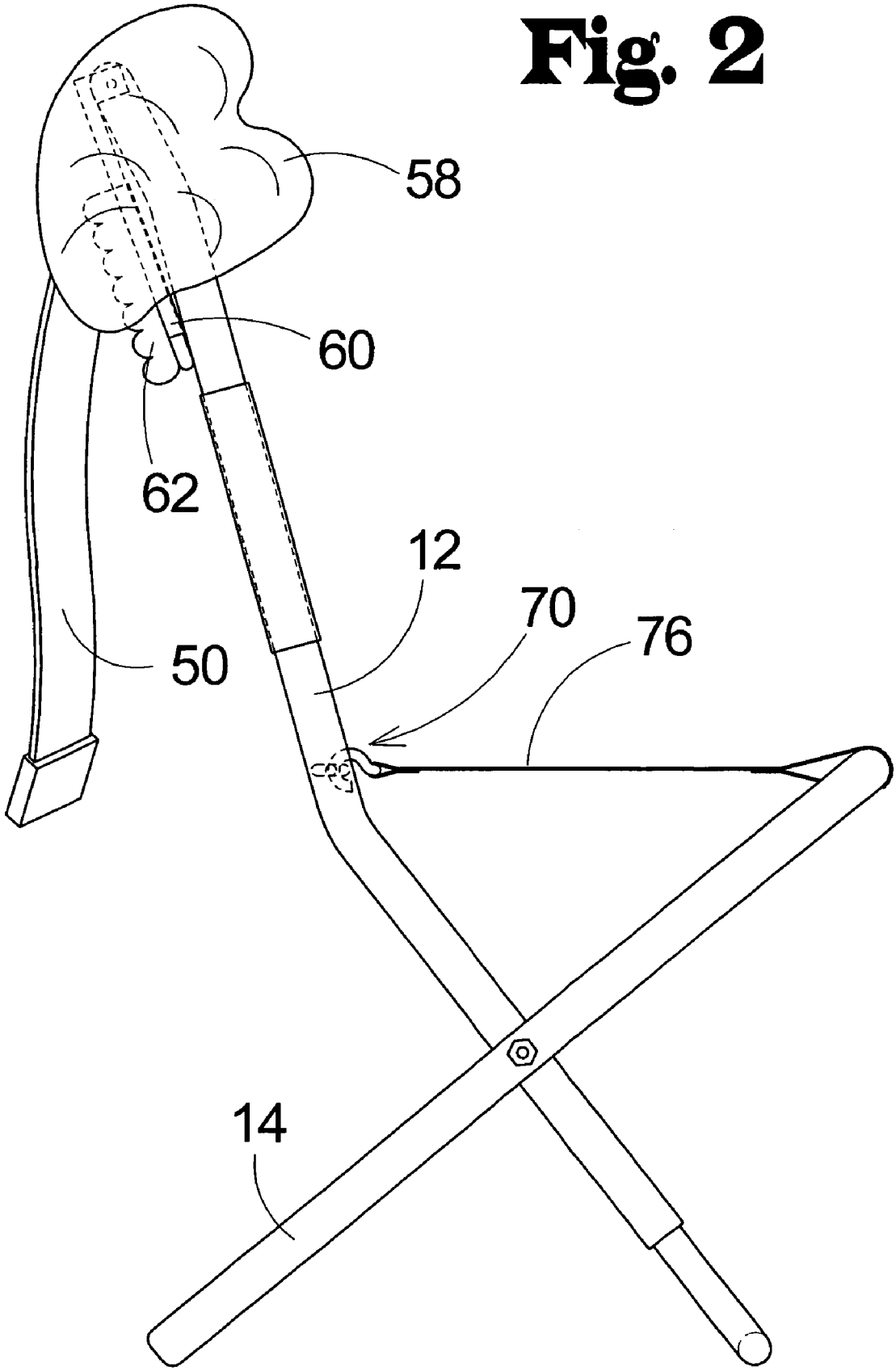
FIG. 2 is a schematic side view of the present invention in the chair configuration with a back rest assembly in the stored condition.
Figure 3:
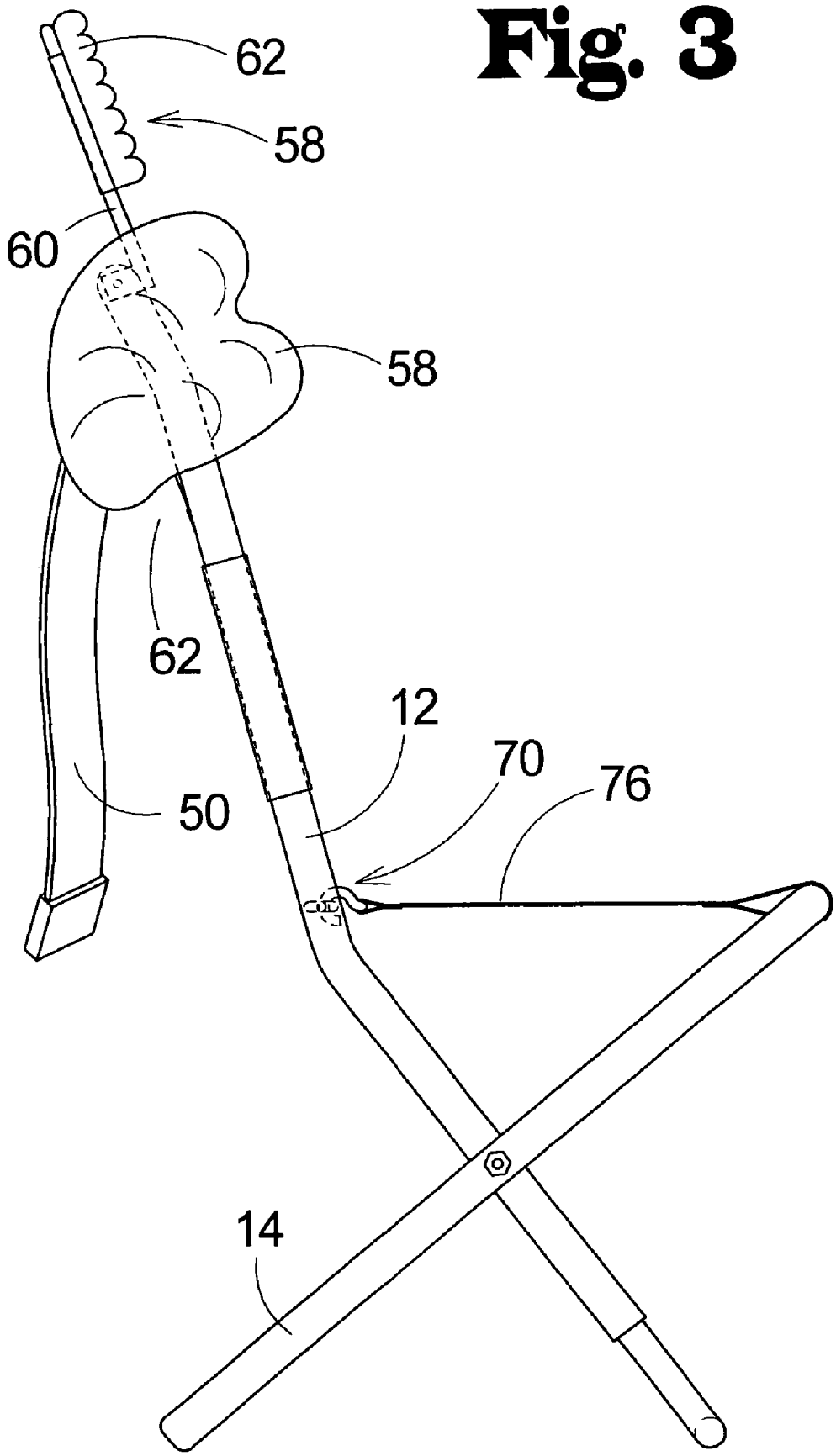
FIG. 3 is a schematic side view of the present invention in the chair configuration with the back rest assembly in the deployed condition.

With reference now to the drawings, and in particular to FIGS. 1 through 7 thereof, a new convertible pack frame between a pack support configuration and a chair configuration that embodies the principles and concepts of the present invention and generally designated by the reference numeral 10 will be described.

A convertible pack frame 10 that is convertible between a pack support configuration that is highly suitable for carrying supplies on the torso of a user, and a chair configuration that is convenient for supporting the user on a ground surface. The convertible pack frame 10 of the invention may include primary 12 and secondary 14 elements that are connected together. The primary 12 and secondary 14 elements are movable between a pack configuration (see FIGS. 4 and 6) and a chair configuration (see FIGS. 1 through 3 and 5). The pack configuration may be characterized by the primary 12 and secondary 14 elements being oriented substantially parallel to each other, and the chair configuration may be characterized by the primary and secondary elements being in a skewed orientation with respect to each other.

In greater detail, the primary element 12 has opposite ends 16, 18, and a first one 16 of the opposite ends may be an upper end in the chair configuration and a second one 18 of the opposite ends may be a lower end in the chair configuration. Conversely, the first one 16 of the opposite ends may be a lower end in the pack configuration and a second one 18 of the opposite ends may be an upper end in the pack configuration. The primary element 12 may form a closed loop. The primary element 12 may include a pair of primary leg portions 20, 22. The primary leg portions 20, 22 may be substantially vertically oriented in the pack configuration. In some embodiments, the each of the primary leg portions 20, 22 has an upper section 24 and a lower section 26, and the upper and lower sections are angled with respect to each other to provide a more comfortable back rest position when the frame is in the chair configuration. Illustratively, the angle between the upper 24 and lower 26 sections is in the range of 10 degrees and 30 degrees, although other angles may be employed.

The primary element 12 may also include at least one primary cross portion 28 that extends between the primary leg portions 20, 22. The primary cross portion 28 may be located toward the first end 16 of the primary leg portions 20, 22. The primary cross portion 28 may be substantially horizontally oriented in both the pack and chair configurations. A pair of primary cross portions 28, may be employed, and a first one 28 of the primary cross portions may be located toward the first end 16 of the primary element and a second one 30 of the primary cross portions may be located toward the second end 18 of the primary element. Additional cross portions 32 may also extend between the pair of primary leg portions. At least one (and optionally more than one) support member 34 may extend between at least two of the additional cross portions 32. A back support panel 36 may be provided for supporting a back of a user seated on the seat, and may extend between the pair of primary leg portions 24, 26. The back support panel 36 may be formed of a flexible and cushioned material. As a further option, a brace member 38 may extend between the primary leg portions 20, 22, and may be mounted on one of the additional cross portions 30.

The secondary element 14 of the pack frame 10 is pivotally mounted on the primary element 12 to permit pivoting of the secondary element between a position adjacent to the primary element 12 for the pack configuration, and away from the primary element for the chair configuration. In some embodiments, the secondary element 14 may be substantially U-shaped, although other shapes and configurations may be employed.

The secondary element 14 may include a pair of secondary leg portions 40, 42 that are substantially vertically oriented in at least the pack configuration. The secondary element 14 may also include a secondary cross portion 44 that extends between the secondary leg portions 40, 42. The secondary cross portion 44 may be located toward the upper ends 46, 47 of the secondary leg portions when the pack frame 10 is in the chair configuration, and may also be substantially horizontally oriented.

In one significant aspect of the invention, the primary element 12 is positioned between the secondary leg portions 40, 42 of the secondary element 14 in the pack configuration, and thus the primary and secondary elements are able to achieve a relatively thin thickness in the pack configuration. A portion of the primary element 12 may be nested in the secondary element 14, which is at least partially a result of the U-shaped configuration of the secondary element 14.

In another significant aspect of the invention, the primary 12 and secondary 14 elements each form the "legs" of the chair configuration of the pack frame 10, so that additional leg or foot elements or structures that would add weight and complexity to the overall frame 10 are avoided.

The convertible pack frame 10 of the invention may also include a securing band 50 for securing the primary element 12 (as well as the secondary element 14 through the primary element) to the body of the user. The securing band 50 may be mounted on the primary element 12, and may be located toward the second end 16 (the lower end in the pack configuration) of the primary element. The securing band 50 may form a loop for looping about the waist of the user. The securing band 50 may be attached to the primary element 12 adjacent to the primary cross portion 28 of the primary element. The securing band 50 having an adjustable length for adjusting a circumference of the securing band. The securing band 50 may optionally include a padded cushion and a strap that has end portions that are connectable together.

The pack frame 10 may also include at least one, and preferably a pair of, shoulder straps 52 for engaging the shoulder of the user when the frame 10 is being worn in the pack configuration. The shoulder straps 52 may be mounted on the primary element 12, with first ends 54 of the shoulder straps being mounted on one of the additional cross portions 32 of the primary element and second ends 56 of the shoulder straps being mounted on one of the primary leg portions 20, 22 or the primary cross portion 30 of the primary element. The shoulder straps 52 may be relatively flexible, and may also include cushions or padding for at least the portions of the straps that abut the user torso.

In one optional embodiment, the pack frame 10 may include an extended back rest assembly 58 that is mounted on the primary element 12. It should be recognized that while this description will use the terminology "extended back rest" assembly, other parts of the body of the user may be supported by or rested against this structure, including, for example, the head of the user. The extended back rest assembly 58 may have a deployed condition (see FIG. 3) and a stored condition (see FIG. 2). In the deployed condition, the back rest assembly 58 may extend from the primary element, and may extend from the upper end of the primary element. In the stored condition, the back rest assembly 58 may be positioned adjacent to the primary element 12 so that the assembly 58 does not extend beyond the primary element.

The extended back rest assembly 58 may comprise a back rest member 60 that is mounted on the primary element 12. The back rest member 60 may be movable between a stored position and a deployed position, which correspond to the respective stored and deployed conditions of the back rest assembly. The back rest member 60 may be pivotably mounted on the primary element 12 such that the back rest member pivots between the stored position (see FIG. 2) and the deployed position (see FIG. 3). The stored position of the back rest member 60 may be characterized by the back rest member extending from the upper end of the primary element 12, and may lie in substantially the same plane as the primary element. The deployed position of the back rest member 60 may be characterized by the back rest member being positioned against the primary element 12 and not extending beyond the end of the primary element. The back rest assembly 58 may also include a cushion 62 mounted on the back rest member. The cushion 62 may extend across the back rest member.

Figure 4:
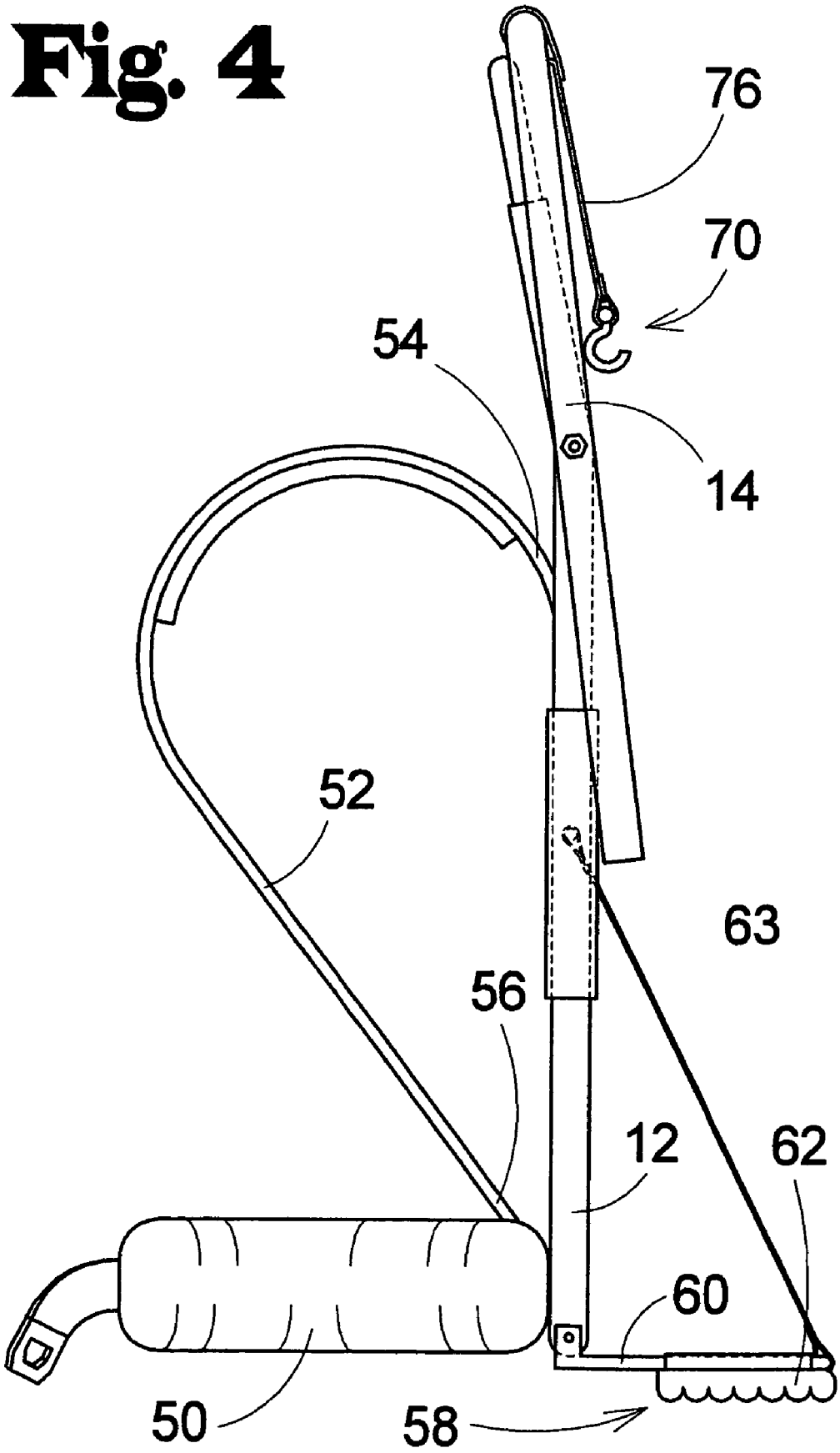
FIG. 4 is a schematic front view of the present invention in the pack configuration.
Figure 5:
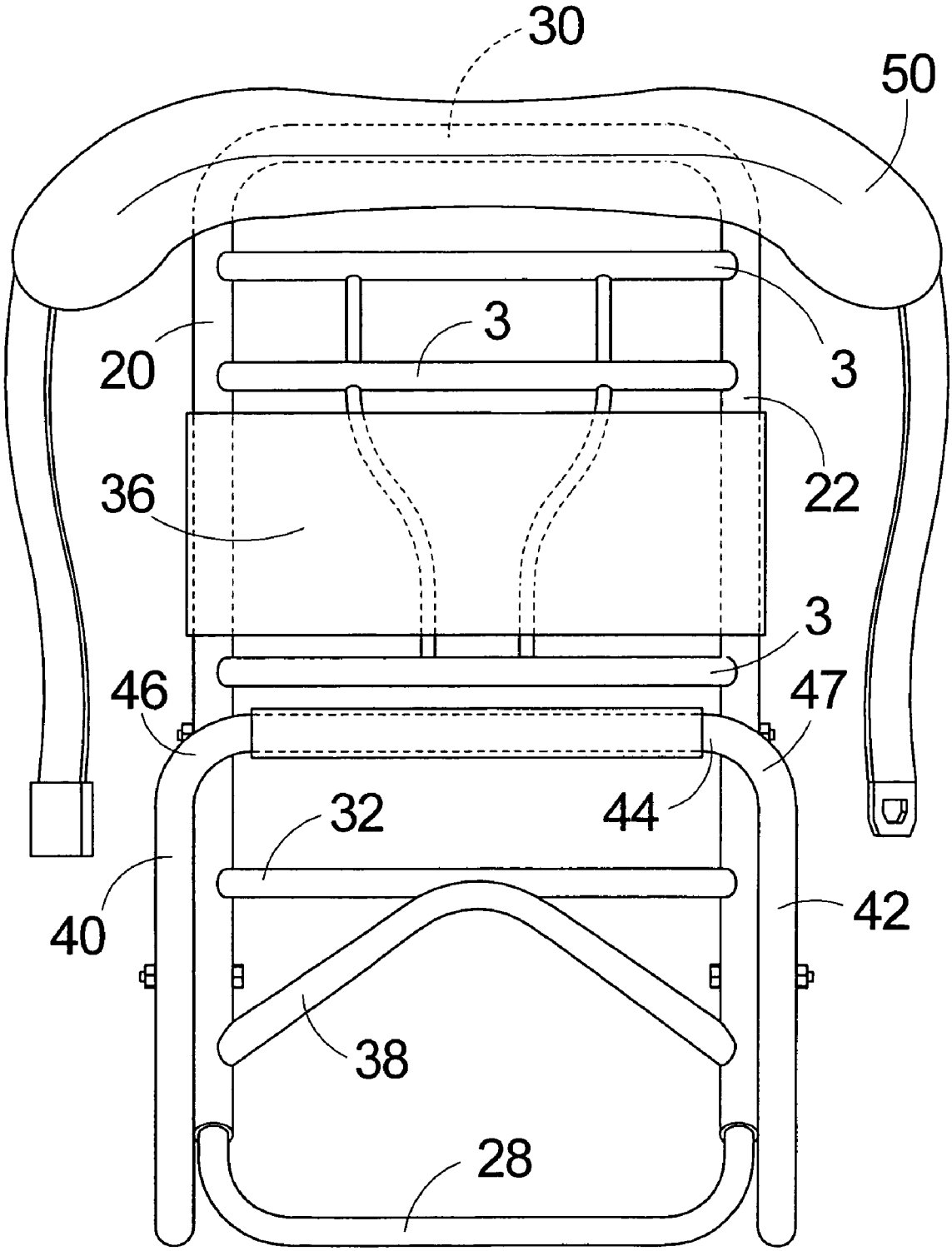
FIG. 5 is a schematic front view of the present invention in the chair configuration.
Figure 6:
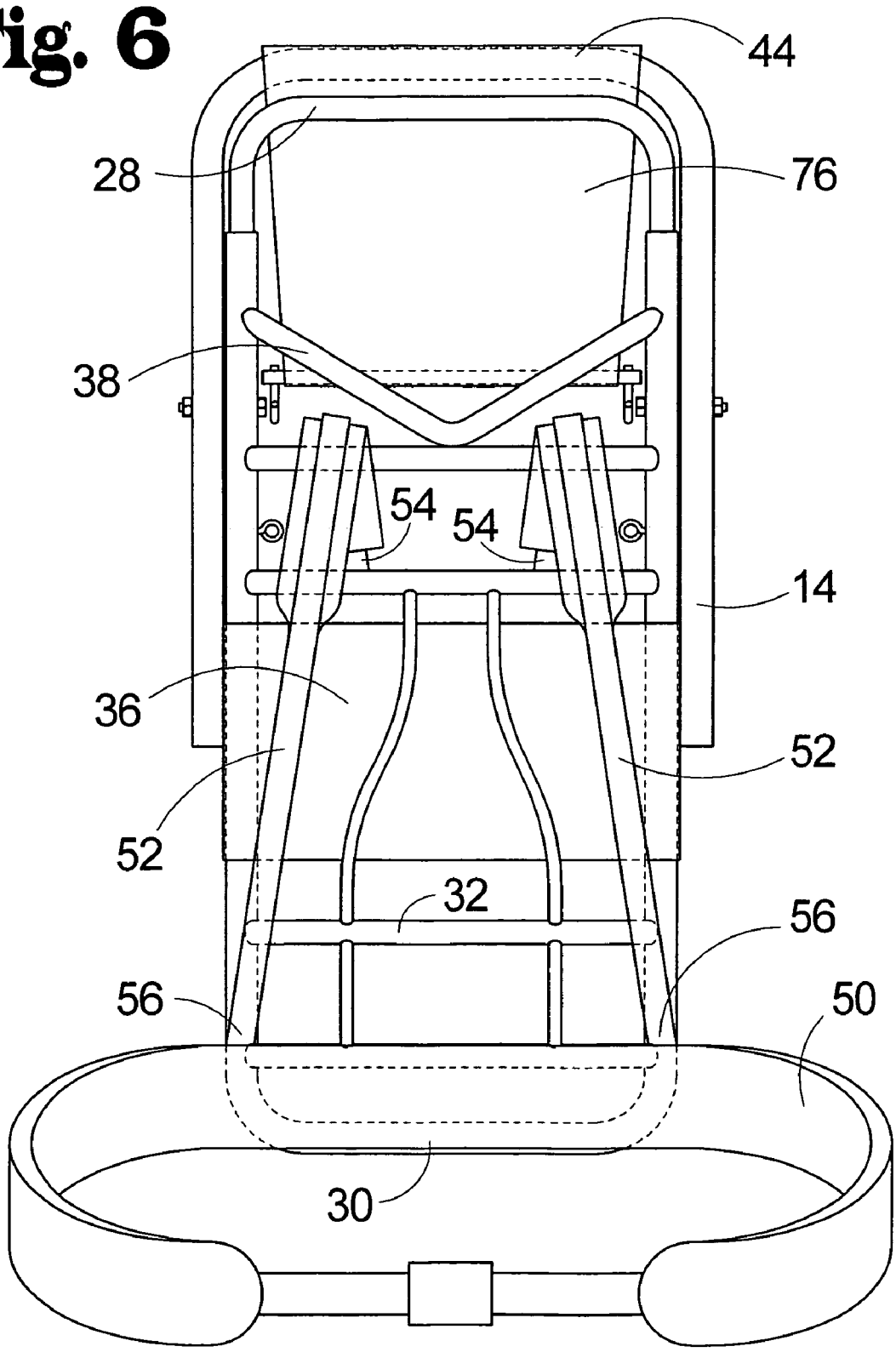
FIG. 6 is a schematic front view of the present invention in the pack configuration.
Figure 7:
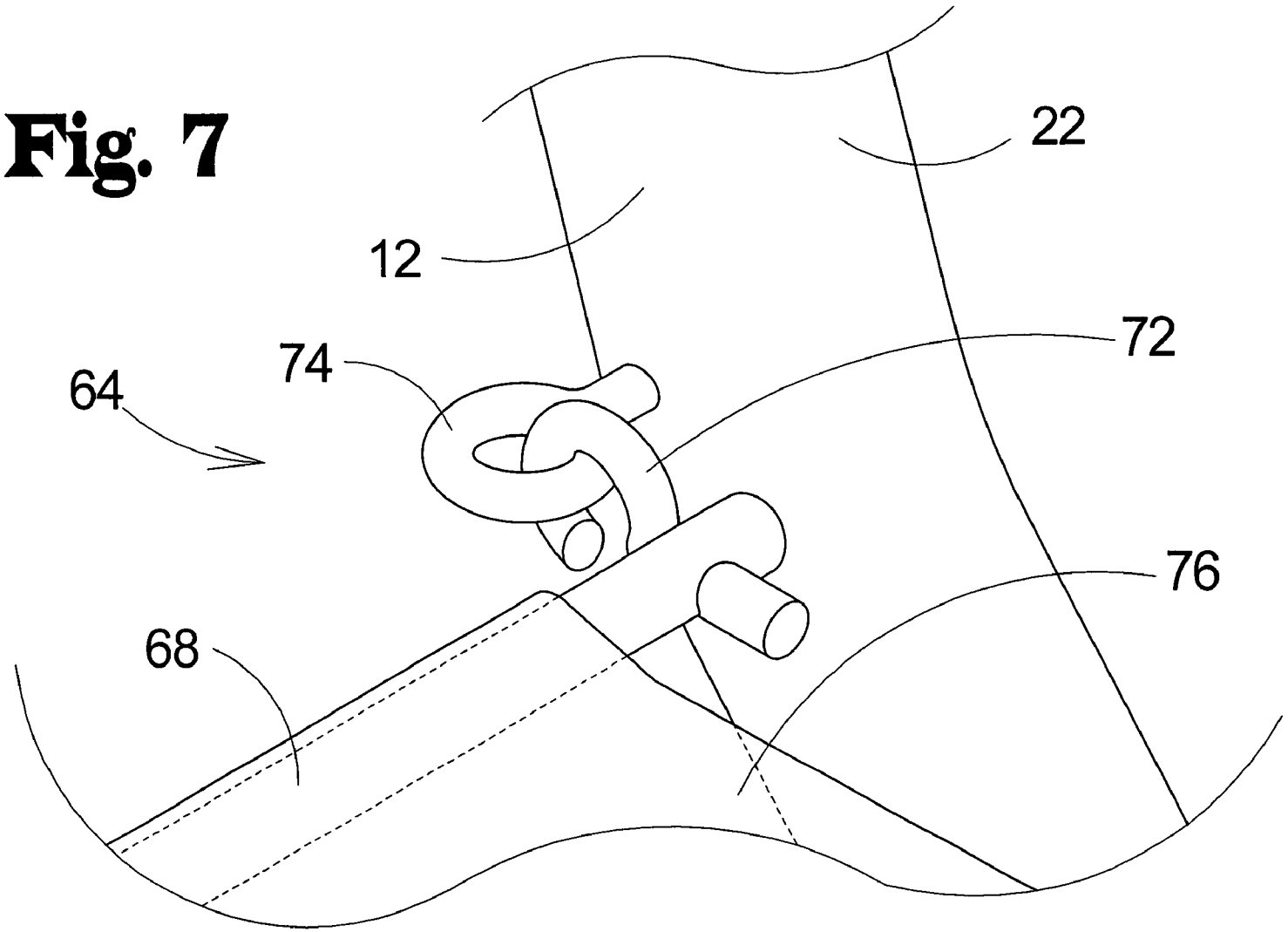
FIG. 7 is a schematic perspective of the present invention in the pack configuration.

Optionally, as shown in FIG. 4, a supplemental support member 63 may be employed to support the back rest member 60 in an intermediate position between the deployed and stored positions of the member 60, which may be useful in the pack configuration of the pack frame 10. The supplemental support member 63 may extend between the back rest member 60 (such as from the outboard end of the back rest member) and a location on the primary element 12 (such as one of the additional cross portions 32).

The pack frame 10 may also include a seat 64 for extending between the primary element 12 and the secondary element 14 when the frame 10 is in the chair configuration. A first side 66 of the seat 64 may be mounted on the secondary cross portion 44 of the secondary element 14, and a second side 68 of the seat is located opposite of the first side of the seat and may be mounted to the primary element 12. A fastening structure 70 may be located on the second side 68 of the seat for removably fastening the second side to the primary element 12. The fastening structure 70 may comprise at least one hook 72 and at least one loop 74. Illustratively, the hook 72, or a pair of hooks, may be mounted on the seat 64 and the loop 74, or a pair of loops, may be mounted on the primary element 12. Each of the loops 74 may be mounted on one of the primary leg portions 20, 22 of the primary element 12. The seat 64 may comprise a panel 76 that extends between the first side 66 and the second side 68 of the seat 64. The panel 76 may be flexible, and may comprise, for example, a cloth material.

In use, the user moves the pack frame 10 between the pack configuration and the chair configuration by pivoting the primary 12 and secondary 14 elements with respect to each other. In the chair configuration, the hooks 72 of the fastening structure 70 may be attached to the loops 74 to position the seat 64 for use, and these elements may be detached from each other when it is desired to reconfigure the pack frame from chair to pack.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pack frame convertible between a pack support and a chair, the convertible pack frame comprising:

a primary element having opposite first and second ends; a secondary element pivotably mounted on the primary element to permit pivoting of the secondary element with respect to the primary element wherein the primary and secondary elements are movable between a pack configuration and a chair configuration, the pack configuration being characterized by the primary and secondary elements being oriented substantially parallel to each other, the chair configuration being characterized by the primary and secondary elements being in a skewed orientation with respect to each other; a securing band for securing the primary element to the body of a user when the primary and secondary elements are in the pack configuration; a seat for extending between the primary element and the secondary element when the primary and secondary elements are in the chair configuration, wherein the seat is mounted on a first one of the primary and secondary elements and the seat is removably fastenable to a second one of the primary and secondary element when the primary and secondary elements are in the seat configuration, wherein the seat is configured to hold the primary and secondary elements in the chair configuration when the seat is fastened to the second one of the primary and secondary elements, and wherein the seat is configured such that the seat must be unfastened from the second one of the primary and secondary elements for the secondary element to be moved from the chair configuration to the pack configuration; and additionally comprising an extended back rest assembly mounted on the primary element, the extended back rest assembly having a deployed condition and a stored condition, the deployed condition of the back rest assembly being characterized by the back rest assembly extending outwardly from one of the ends of the primary element, the stored condition being characterized by the back rest assembly being pivoted back upon the primary element so as not to extend from the one end of the primary element and wherein the back rest member has an intermediate condition between the deployed and stored conditions of the back rest member to form a support, the intermediate condition being characterized by the back rest member being in an orientation substantially perpendicular to a plane of the primary element, the back rest being supported in the intermediate condition by a supplemental support member extending from the primary element, the supplemental support member comprising a tie.

2. The pack frame of claim 1 wherein the extended back rest assembly comprises a back rest member pivotally mounted on the primary element and being pivotally movable between a stored position corresponding to the stored condition of the back rest assembly and a deployed position corresponding to the deployed condition of the back rest assembly.

3. The pack frame of claim 1 additionally comprising at least one shoulder strap for engaging the shoulder of the user, the shoulder strap being mounted on the primary element.

4. The pack frame of claim 3 wherein the at least one shoulder strap comprises a pair of shoulder straps.

5. The pack frame of claim 1 wherein the primary element includes a pair of primary leg portions and at least one primary cross portion extending between the primary leg portions.

6. The pack frame of claim 5 wherein the secondary element includes a pair of secondary leg portions and a secondary cross portion extending between the secondary leg portions, the secondary leg portions each being mounted on one of the primary leg portions of the primary element.

7. The pack from frame of claim 1 wherein the chair configuration is characterized by the first end of the primary element being positioned relatively higher than the second end of the primary element, and wherein the pack configuration is characterized by the first end of the primary element being positioned relatively lower than the second end of the primary element.

8. The pack frame of claim 1 wherein the securing band is mounted on the primary element, the securing band being located toward the first end of the primary element.

9. The pack frame of claim 1 wherein a first side of the seat is mounted on the secondary element and a second side of the seat being located opposite of the first side of the seat is removably mounted on the primary element.

10. The pack frame of claim 1 additionally comprising an extended back rest assembly mounted on the primary element, the extended back rest assembly having a deployed condition and a stored condition, the deployed condition of the back rest assembly being characterized by the back rest assembly extending outwardly from one of the ends of the primary element, the stored condition being characterized by the back rest assembly being pivoted back upon the primary element so as not to extend from the one end of the primary element and; wherein the extended back rest assembly comprises a back rest member pivotally mounted on the primary element and being pivotally movable between a stored position corresponding to the stored condition of the back rest assembly and a deployed position corresponding to the deployed condition of the back rest assembly; at least one shoulder strap for engaging the shoulder of the user, the shoulder strap being mounted on the primary element; wherein the at least one shoulder strap comprises a pair of shoulder straps; wherein the primary element includes a pair of primary leg portions and at least one primary cross portion extending between the primary leg portions; wherein the secondary element includes a pair of secondary leg portions and a secondary cross portion extending between the secondary leg portions, the secondary leg portions each being mounted on one of the primary leg portions of the primary element; wherein the chair configurations is characterized by the first end of the primary element being positioned relatively higher than the second end of the primary element, and wherein the pack configuration is characterized by the first end of the primary element being positioned relatively lower than the second end of the primary element; wherein the securing band is mounted on the primary element, the securing band being located toward the first end of the primary element; and wherein a first side of the seat is mounted on the secondary element and a second side of the seat is being located opposite of the first side of the seat is removably mounted on the primary element; a fastening structure located on one side of the seat and configured to removably fasten the side of the seat to the second one of the primary and secondary elements, the fastening structure comprising at least one hook on the side of the seat and at least one loop mounted on the second one of the primary and secondary elements; wherein the fastening structure comprises a pair of hooks mounted on the side of the seat and a pair of loops mounted on the primary element, with each of the loops being mounted on a respective one of a pair of primary leg portions of the primary element.

11. The pack frame of claim 1 additionally comprising a fastening structure located on one side of the seat and configured to removably fasten the side of the seat to the second one of the primary and secondary elements, the fastening structure comprising at least one hook on the side of the seat and at least one loop mounted on the second one of the primary and secondary elements.

12. The pack frame of claim 11 wherein the fastening structure comprises a pair of hooks mounted on the side of the seat and a pair of loops mounted on the primary element, with each of the loops being mounted on a respective one of a pair of primary leg portions of the primary element.

13. The pack frame of claim 1 wherein the chair configuration is characterized by a first end of the primary element being located vertically higher than an opposite second end of the primary element, and the pack configuration is characterized by the second end of the primary element being located vertically higher than the first end of the primary element, such that the primary element is inverted when changed from the chair configuration to the pack configuration.

14. A pack frame convertible between a pack support and a chair, the convertible pack frame comprising:

a primary element having opposite first and second ends; a secondary element pivotably mounted on the primary element to permit pivoting of the secondary element with respect to the primary element; wherein the primary and secondary elements are movable between a pack configuration and a chair configuration, the pack configuration being characterized by the primary and secondary elements being oriented substantially parallel to each other, the chair configuration being characterized by the primary and secondary elements being in a skewed orientation with respect to each other; a securing band configured to secure the primary element to the body of a user when the primary and secondary elements are in the pack configuration; a seat extendable between the primary element and the secondary element when the primary and secondary elements are in the chair configuration; an extended back rest assembly mounted on the primary element, the extended back rest assembly having a deployed condition and a stored condition, the deployed condition of the back rest assembly being characterized by the back rest assembly extending outwardly from one of the ends of the primary element, the stored condition being characterized by the back rest assembly being pivoted back upon the primary element so as not to extend from the one end of the primary element and wherein the back rest member has an intermediate condition between the deployed and stored conditions of the back rest member to form a support, the intermediate condition being characterized by the back rest member being in an orientation substantially perpendicular to a plane of the primary element, the back rest being supported in the intermediate condition by a supplemental support member extending from the primary element, the supplemental support member comprising a tie.

* * * * *